US010570644B2

(12) United States Patent
Griffin

(10) Patent No.: US 10,570,644 B2
(45) **Date of Patent: *Feb. 25, 2020**

(54) LOCKOUT SYSTEM FOR ENERGY SOURCES

(71) Applicant: Jason P. Griffin, Manchester, NH (US)

(72) Inventor: Jason P. Griffin, Manchester, NH (US)

( * ) Notice: Subject to any disclaimer, the term of this patent is extended or adjusted under 35 U.S.C. 154(b) by 16 days.

This patent is subject to a terminal disclaimer.

(21) Appl. No.: 15/785,582

(22) Filed: Oct. 17, 2017

(65) Prior Publication Data

US 2018/0240616 A1 Aug. 23, 2018

Related U.S. Application Data

(63) Continuation of application No. 15/435,365, filed on Feb. 17, 2017, now Pat. No. 9,881,749.

(51) Int. Cl.
*E05B 51/00* (2006.01)
*E05B 65/48* (2006.01)
(Continued)

(52) U.S. Cl.
CPC ..... *E05B 51/00* (2013.01); *E05B 37/0096* (2013.01); *E05B 39/04* (2013.01); *E05B 41/00* (2013.01); *E05B 43/005* (2013.01); *E05B 63/0004* (2013.01); *E05B 63/0052* (2013.01); *E05B 63/0069* (2013.01);
(Continued)

(58) Field of Classification Search
CPC ..... H01H 9/20; H01H 9/281; H01H 9/282; H01H 9/283; E05B 63/0069; E05B 67/38; E05B 65/48; E05B 65/0089; E05B 65/006; E05B 63/123; E05B 63/0052; E05B 63/0004; E05B 51/00; E05B 43/005; E05B 41/00; E05B 39/04; E05B 37/0096; E05B 2047/0067; E05B 2047/0071; E05B 63/143; E05B 67/383; E05B 17/226; E05B 2047/0094; E05B 67/32; G07C 9/00309; G07C 2009/00769; G07C 9/00896; G09F 3/20
USPC ..... 70/14–19, 36, 37, 177–180, 278.7, 70/DIG. 63, DIG. 30; 292/281–286, 292/307 R, 307 A, 328, 329; 40/649,
(Continued)

(56) References Cited

U.S. PATENT DOCUMENTS 5,020,342 A * 6/1991 Doan ..... E05B 67/383 24/601.7
5,743,116 A * 4/1998 Suster ..... E05B 67/383 70/14

(Continued)

*Primary Examiner* — Lloyd A Gall
(74) *Attorney, Agent, or Firm* — Sarita L. Pickett

(57) ABSTRACT

A lockout system includes a hasp assembly and a plurality of tags. The hasp assembly has a back plate defining slots each sized and shaped to receive a tag. The back plate and tags each have openings that align when a tag is received in a slot. A first hasp portion on the back plate defines part of a closed loop. A longitudinal locking bar is slidable along the back plate and has notches shaped to receive ends of the tags. Moving the locking bar between an unlocked position and a locked position operates the second hasp portion between an open position and a closed position. In the closed position, the first and second hasp portions complete and define the closed loop, where one or more tags can be installed in slots with the first end of the tag engaging a notch to lock closed the hasp portion.

8 Claims, 9 Drawing Sheets

(51) Int. Cl.

| | |
|---|---|
| ***E05B 41/00*** | (2006.01) |
| ***G07C 9/00*** | (2020.01) |
| ***E05B 37/00*** | (2006.01) |
| ***E05B 39/04*** | (2006.01) |
| ***E05B 43/00*** | (2006.01) |
| ***E05B 63/00*** | (2006.01) |
| ***E05B 63/12*** | (2006.01) |
| ***E05B 65/00*** | (2006.01) |
| ***E05B 67/38*** | (2006.01) |
| *E05B 47/00* | (2006.01) |

(52) U.S. Cl.
CPC ..... *E05B 63/123* (2013.01); *E05B 65/006* (2013.01); *E05B 65/0089* (2013.01); *E05B 65/48* (2013.01); *E05B 67/38* (2013.01); *G07C 9/00309* (2013.01); *E05B 2047/0067* (2013.01); *E05B 2047/0071* (2013.01); *G07C 2009/00769* (2013.01)

(58) Field of Classification Search
USPC ..... 40/657; 340/539.1, 542, 5.31; 200/43.11, 43.14, 43.15, 43.22
See application file for complete search history.

(56) References Cited

U.S. PATENT DOCUMENTS 5,881,582 A * 3/1999 Monaco ..... E05B 67/383 70/14
6,504,480 B1 * 1/2003 Magnuson ..... G07C 9/00142 340/5.1
6,513,349 B1 * 2/2003 Miao ..... A45C 13/42 206/38
6,557,384 B1 * 5/2003 Cuesta ..... E05B 67/22 70/14
6,718,674 B2 * 4/2004 Caveney ..... G09F 3/20 40/611.09
7,370,892 B2 * 5/2008 Collingham ..... G09F 3/0311 24/704.1
7,389,599 B2 * 6/2008 Hishinuma ..... G09F 3/20 40/375
8,353,182 B2 * 1/2013 Triffle ..... E05B 67/383 70/14
8,408,609 B2 * 4/2013 Brojanac ..... E05B 67/383 292/285
8,601,732 B2 * 12/2013 Kolton ..... G09F 3/20 40/662
8,791,820 B2 * 7/2014 Morrow ..... E05B 45/06 200/61.64
8,839,649 B1 * 9/2014 Miller ..... H01H 9/282 70/14
8,910,498 B2 * 12/2014 Saucier ..... A47G 29/10 109/53
9,501,046 B2 * 11/2016 Kalous ..... G05B 1/01
9,881,749 B1 * 1/2018 Griffin ..... E05B 17/226
2007/0131007 A1 * 6/2007 Hacker ..... E05B 39/00 70/433
2009/0277053 A1 * 11/2009 Critelli ..... G09F 3/14 40/27

* cited by examiner (PRIOR ART)

LOCKOUT SYSTEM FOR ENERGY SOURCES

This application claims benefit to application Ser. No. 15/435,365 filed on Feb. 17, 2017; was granted as U.S. Pat. No. 9,881,749; and which claims benefit to provisional application No. 62/296,910, filed on Feb. 18, 2016.

BACKGROUND OF THE INVENTION

1. Field of the Invention

The present invention relates generally to industrial safety devices. More particularly, the present invention relates to a lockout system and apparatus for use with industrial equipment and energy sources.

2. Description of the Prior Art

Energy sources in machines and equipment is a hazard to workers. Energy sources include electrical, mechanical, hydraulic, pneumatic, chemical, and thermal energy sources. Workers servicing or maintaining machines or equipment must properly control energy sources to avoid accidents. While servicing and maintaining machines and equipment, for example, an unexpected machine startup or release of stored energy can result in serious injury or death to workers. Injuries resulting from a failure to control hazardous energy during maintenance activities can be fatal and include burns, crush injuries, cuts, lacerations, amputations, and bone fractures.

For example, a steam valve opened automatically can burn workers who are repairing a downstream connection in the piping. A jammed conveyor system can suddenly release and crush a worker attempting to clear the jam. Internal wiring on factory equipment can electrically short, causing electric shock to the worker who is performing a repair.

Industrial workers, electricians, machine operators, and laborers are among the millions of workers who service equipment routinely and face the greatest risk of injury. A worker injured on the job from exposure to hazardous energy will require an average of 24 work days to recuperate from injuries. This recuperation time is costly in the form of lost productivity, medical expenses, lost revenue, other expenses, and as reduced morale after an accident.

To properly control hazardous energy and protect workers from these hazards, lockout/tagout (LOTO) practices and procedures have been established by the Occupational Safety and Health Administration (OSHA). OSHA's regulation is titled Control of Hazardous Energy and is published as 29 C.F.R. § 1910.147. This regulation outlines specific action and procedures for addressing and controlling hazardous energy during service and maintenance of machines and equipment used in general industry. Employers are required to train each worker to ensure that they know, understand, and are able to follow the applicable provisions of the hazardous energy control procedures. Requirements include knowing the purpose and function of the energy control program and having the knowledge and skills to safely apply, use, and remove energy control devices.

All employees who work in an area where energy control procedure is utilized need to be instructed in the purpose of and procedure to control energy, especially the prohibition against attempting to restart or reenergize machines or other equipment that are locked or tagged. All employees who are authorized to lockout machines or equipment and perform the service and maintenance operations need to be trained to recognize hazardous energy sources in the workplace, the type and magnitude of energy found in the workplace, and the appropriate means and methods of isolating and/or controlling the energy.

Proper procedure for controlling energy includes using lockout/tagout devices to shut down equipment and machines for service or repair. FIG. 1 shows an example of a prior art lockout/tagout kit 10 that includes a hasp 12, a plurality of tags 20, and a plurality of locks 30. Hasp 12 has two hasp parts 12*a*, 12*b*, each of which has a hook portion 14 and a body portion 16 with openings 17. Hasp parts 12*a*, 12*b* rotate about a connector 18 between an open position and a closed position. In the closed position as shown in FIG. 1, the hook portions 14 are brought together to define a closed loop that may be installed through an equipment switch. In the closed position, the body portions 16 also overlap with the openings 17 aligned so that a lock 30 can be fastened through each opening 17 to prevent the hasp 12 from being opened. Each worker servicing a machine or piece of equipment will attach a lock 30 to the hasp 12 while servicing a machine. Each worker removes his lock 30 when his service has been completed. After all locks 30 have been removed, the machine is now available for use.

In the open position, hasp parts 12*a*, 12*b* rotate about connector 18 in opposite directions so that the hook portions 14 open and the body portions 16 move away from each other. When all locks 30 are removed from the hasp 12, hasp parts 12*a*, 12*b* can be moved to the open position so the hasp 12 can be removed from the equipment.

FIG. 2 shows an example of a prior-art method of locking out a valve 24 with a hasp 12 attached to the valve lock 26 and secured with three locks 30 installed through body portions 16. A tag 20 is installed on the pipe next to the valve being locked in a closed position. In many cases, each user installs a tag 20 on the lock 30 to identify the person who installed the lock 30 and the reason for doing so.

FIG. 3 shows another example of a prior-art method of locking an electrical switch 40 in an "off" position using a hasp 12 and locks 30. With one or more locks 30 attached to the hasp 12, the hasp 12 cannot be opened and removed from the switch 40. Accordingly, the switch 40 cannot be operated because the hasp 12 blocks its movement to the "on" position.

SUMMARY OF THE INVENTION

The lockout/tagout kits 10 currently available generally function as intended to prevent turning on a machine, opening a valve, energizing a line or the like. However, these prior-art kits become unwieldy and inconvenient to use especially when multiple workers have locked a machine. A zip tie is often used to attach a name tag to a padlock that is secured to the hasp. When many workers install locks and tags on a hasp to lock out a piece of equipment, the access to the hasp is restricted and the general appearance of the lockout/tagout equipment is confusing and disorganized. The jumble of locks and tags is inconvenient to use, sometimes deterring workers from complying with lockout procedures. Also, it can be difficult to identify all of the workers who have locks on the hasp due to the disorganization of the locks and tags.

Also, workers find it uncomfortable and inconvenient to carry a tag and lock with them while on the job. This inconvenience further discourages workers from following proper lockout/tagout procedure. Since compliance with procedure is essential for workplace safety, the current lockout/tagout equipment leaves room for improvement.

Further, no system exists that allows a supervisor to remotely determine which pieces of equipment are locked and by whom. Therefore, what is needed is a lockout system and apparatus that is more convenient and efficient to use by workers.

Further, no lockout devices of the prior art provide wireless communication between the hasp assembly and a remote database or computer. Thus, a need exists for improved lockout systems.

It is an objective of the present invention to facilitate compliance with lockout/tagout procedure, therefore improving worker safety and reducing workplace accidents from stored energy sources. The present invention achieves these and other objectives by providing a lockout system and apparatus that includes a hasp assembly and a plurality of tags, where the hasp assembly can be retained in a locked position when one or more tags are received in the hasp assembly.

In one embodiment, each tag has an elongated shape with a first end and a second end. Each tag defines a tag opening. The hasp assembly includes a back plate defining a plurality of slots each sized and shaped to receive one of the plurality of tags and defining a plurality of back plate openings that align with the tag opening of each tag one or more tags are received in respective slots. A first hasp portion extends from an end of the back plate and defines a first portion of a closed loop. A longitudinal locking bar is slidable along the back plate and defines notches each sized and shaped to receive the first end of a tag. A second hasp portion is attached to the back plate and defines a second portion of the closed loop. Sliding the locking bar between an unlocked position and a locked position operates the second hasp portion between an open position and a closed position, respectively. In the closed position, the second hasp portion and the first hasp portion complete and define the closed loop. Tags may be made of metal, ABS plastic, or any other suitable material.

When the locking bar is in the closed position, one or more of the tags can be installed in respective slot or with the first end of the tag engaging a respective notch on the locking bar. When tags are received in the slots and engage the locking bar, the tag opening of each tag received in the slot is aligned with a respective back plate opening. As such, the tag openings and back plate openings align for securing the tag and hasp assembly together using a padlock or the like, thereby fixing the system in the closed position.

In one embodiment, the hasp assembly includes a front plate secured to the back plate and covering all or part of the slots. Entrance openings between the front plate and back plate receive tags into the slots. Thus, tags are slidingly inserted through the entrance openings between the front plate and the back plate. In one embodiment, the front plate defines and frames a central open area. When the hasp assembly includes the front plate, the front plate is useful to retain the tags in the slots.

In another aspect of the present invention, a lockout system includes a plurality of tags each comprising an elongated plate with a first end and a second end, where tag defines a tag opening. A hasp assembly has a hasp body defining a plurality of slots, where each slot is sized and shaped to slidingly receive one of the plurality of tags and defines a lock opening positioned to align with the tag opening of a respective tag received or installed in the slot. A first hasp portion defines a first closed loop portion and extends from an end portion of the hasp body. A locking bar is slidable along the hasp body between an unlocked position and a locked position. The locking bar defines a plurality of notches each sized and shaped to matingly receive the first end of one of a tag, where the notches align with the slots when the locking bar is in the locked position and the slots are offset from the notches when the locking bar is in the unlocked position. A second hasp portion is movably attached to the hasp body and defines a second closed loop portion. The second hasp portion moves between an open position in which the locking bar is the unlocked position, and a closed position in which the locking bar is in the locked position. The second hasp portion and the first hasp portion complete and define the closed loop when the second hasp portion is in the closed position. Installing one or more tags in slots of the hasp assembly prevents the second hasp portion from moving to the open position.

In another embodiment, the hasp assembly includes a back plate defining the plurality of slots and a front plate aligned with and secured to the back plate to define entrance openings between the back plate and the front plate for each slot.

In another embodiment, the hasp assembly includes a tumbler assembly in the hasp body. The tumbler assembly may be used to set a date. In one embodiment, the tumblers are locked in position when the hasp is in the closed position.

In another embodiment, the hasp assembly includes an electronic display on the hasp body, where the electronic display is configured to recognize the presence of one or more tags installed in the hasp assembly. In one embodiment, each slots has electrical slot contacts that are coupled to the electronic display. Each tag has electrical tag contacts, where any tags installed in the hasp body results in a completed circuit with the electronic display's processor. In another embodiment, each tag has a transmitter circuit and the electronic display has a transceiver circuit. Each tag communicates wirelessly with the transceiver circuit when the tag is installed in the hasp assembly.

In another embodiment, the system includes a database disposed in communication with the hasp assembly and one or more computers are disposed in communication with the database. The hasp assembly communicates lockout information to the database and each computer is configured to display the lockout information to a user. In one embodiment, for example, the lockout information includes data selected from a lockout status, a tag identifier, a lockout date, a tag removal date, a worker identifier, a work code, and a slot identifier.

In another aspect of the present invention, a lockout system includes one or more hasp assembly, a plurality of ID tags, and one or more computer. Each hasp assembly includes a hasp body defining a plurality of tag slots each having a lock opening, a hasp connected to and extending from the hasp body and operable between an open hasp position and a closed hasp position, and a locking bar movable along the hasp body portion between a locking position and an unlocking position. Moving the locking bar to the locking position moves hasp to the closed hasp position and moving the locking bar to the unlocking position moves the hasp to the open hasp position. The hasp assembly also has an electronic display on the hasp body, where the electronic display has a processor and a transceiver circuit. Each ID tag has a first end portion and a second end portion that defines a tag opening. Each ID tag is configured to be removably installed in any of the plurality of tag slots with the first end portion engaging the locking bar and the tag opening aligned with a corresponding lock opening. When an ID tag is installed in the hasp body, the locking bar is prevented from moving to the unlocking position, thereby preventing the hasp from changing to the open hasp position. When an ID tag is installed in the hasp body each of the plurality of ID tags communicates a tag identifier to the electronic display. Each computing device is disposed in wireless communication with the transceiver circuit and is configured to communicate wirelessly with the transceiver circuit and display to a user the data transmitted by the transceiver circuit.

In another embodiment, the lockout system includes a padlock with a padlock hasp sized to extend through the lock opening and corresponding tag opening of one of the plurality of ID tags installed in the hasp body.

In another embodiment, the lockout system includes a transmitter circuit disposed on each of the plurality of ID tags, where the transmitter circuit is configured to communicate wirelessly with the transceiver circuit when the ID tag is installed in the tag slot of the hasp assembly.

In another embodiment, the lockout system includes electrical slot contacts in each of the plurality of tag slots and each ID tag has electrical tag contacts, where the electrical slot contacts and the electrical tag contacts are configured to align and engage when an ID tag is installed in one of the plurality of tag slots.

Another aspect of the present invention is directed to a method of locking an energy source comprising the steps of providing a hasp assembly defining a plurality of tag slots each defining a lock opening, where the hasp assembly has an openable hasp and a locking bar operable with the openable hasp by moving between a locked position and an unlocked position, the locking bar defining a plurality of notches configured to align with respective ones of the plurality of tag slots when the locking bar is in the locked position; providing a plurality of tags each defining a tag opening and configured to be removably installed in one of the tag slots with a first end portion of the tag sized to be received in one of the notches and the tag opening aligned over a lock opening; moving the locking bar to the unlocked position, thereby opening the openable hasp; installing the hasp through a lock opening on an energy source to be locked; moving the locking bar to the locked position, thereby closing the openable hasp and aligning the notches in the locking bar with the tag slots; installing one or more tags into the hasp assembly with each first end portion received in one of the notches and the tag opening aligned over a corresponding lock opening; providing one or more padlocks each having a padlock hasp sized to extend through the tag opening of a tag and through the corresponding lock opening of a tag slot; and locking one padlock with the padlock hasp extending through the tag opening and the corresponding lock opening, thereby preventing the one of the plurality of tags tag from being removed from the corresponding tag slot, preventing the locking bar from moving to the unlocked position, and locking the hasp in the closed position.

In another embodiment, the method also includes the steps of providing a computer with a display device and configured for wireless communication; selecting the hasp assembly to include a transceiver circuit disposed in communication with the computer and configured to detect the presence of one or more tags installed in the hasp assembly; selecting the tags configured to communicate a unique tag ID to the transceiver circuit when installed in the hasp assembly; the transceiver circuit receiving data from one or more tags installed in the hasp assembly; the transceiver circuit transmitting data to the computer in response to receiving data from one or more tags; the computer receiving data transmitted by the transceiver circuit; and the display device displaying to a user the data transmitted by the transceiver circuit.

In another embodiment of the method, data transmitted by the transceiver circuit includes one or more item selected from a unique tag ID, an energy source identifier, a worker identifier, a lockout date, a tag installation date, a tag removal date, and a lockout status identifier.

DETAILED DESCRIPTION

Figure 1:
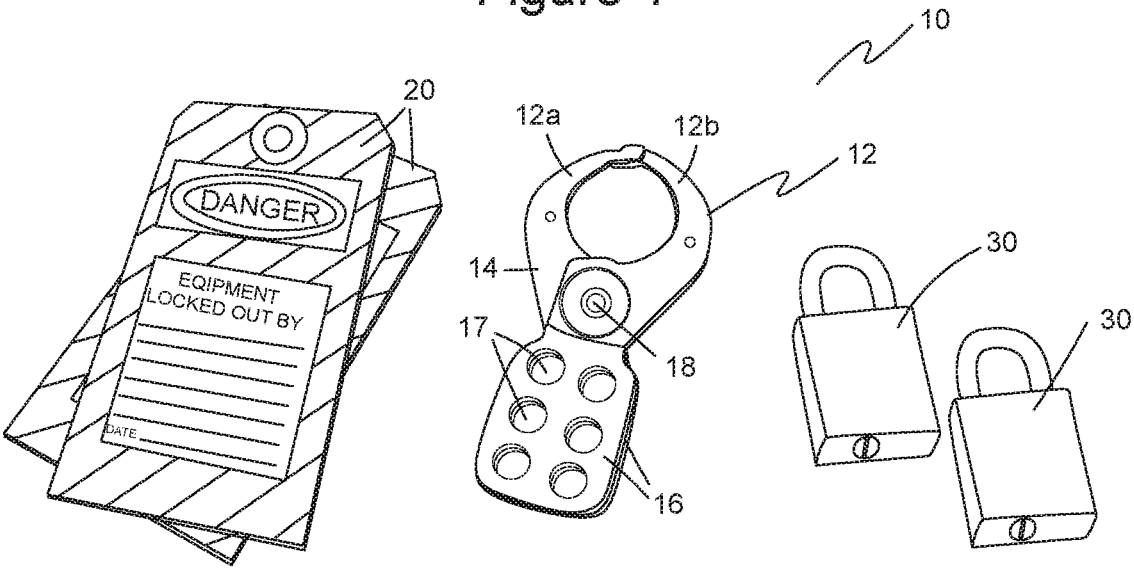
FIG. 1 is a photo showing an example of a prior-art lockout/tagout kit that includes a hasp, tags, and a lock with keys.
Figure 2:
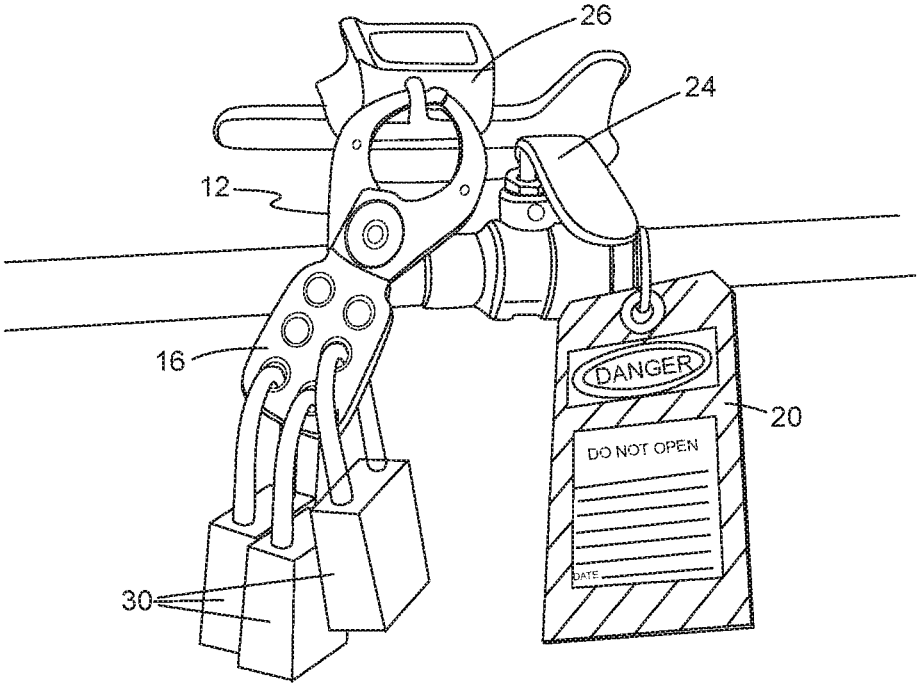
Figure 2 (PRIOR ART)
FIG. 2 is a photo of a prior-art lockout/tagout kit in use on a valve.
Figure 3:
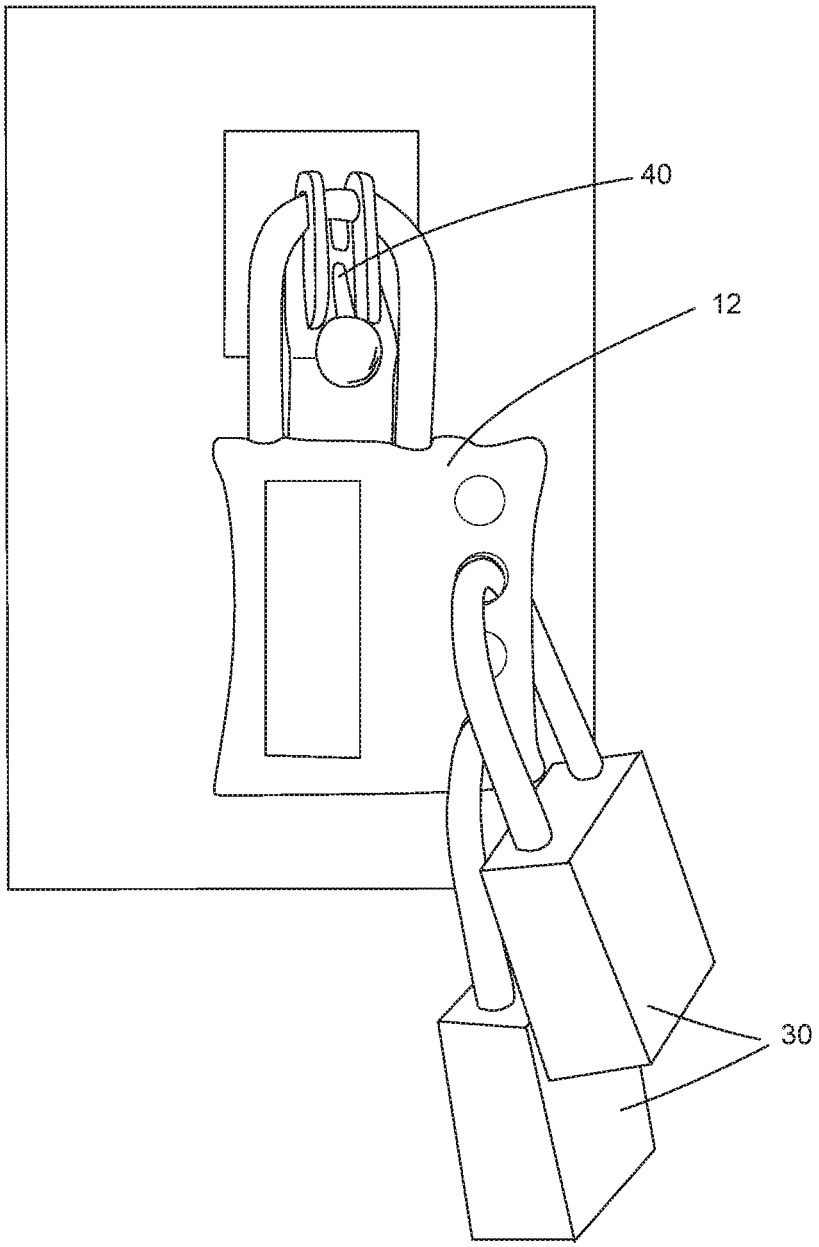
Figure 3 (PRIOR ART)
FIG. 3 is a photo of another prior-art lockout hasp in use with locks on an electrical panel.
Figure 4:
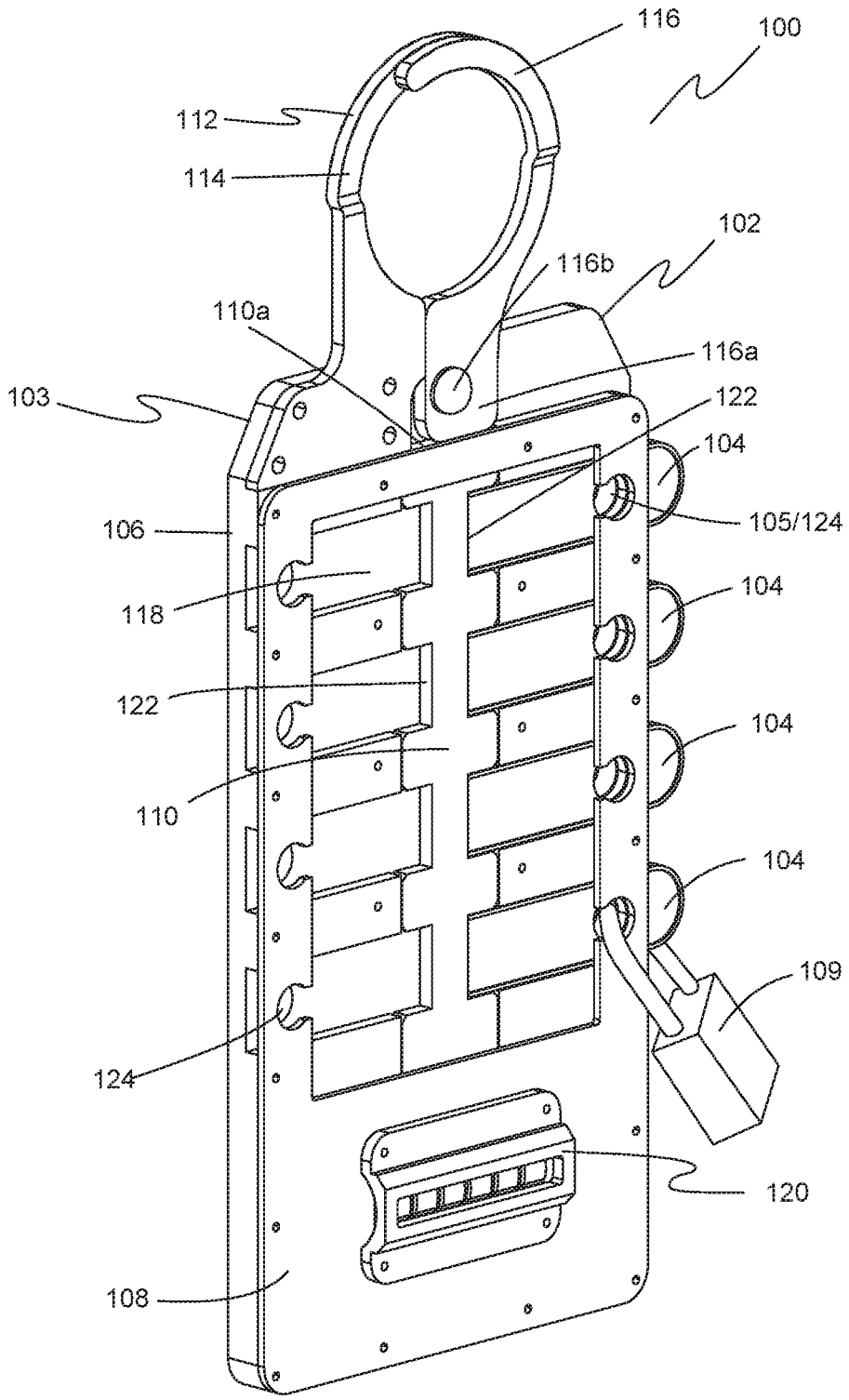
FIG. 4 illustrates a perspective view of one embodiment of a lockout system of the present invention showing the lockout system in a closed position.

Exemplary embodiments of the present invention are illustrated in FIGS. 4-14. FIG. 4 illustrates a perspective view of one embodiment of a lockout system 100 of the present invention that includes a lockable hasp assembly 102 and a plurality of tags 104 that can be independently received by and removed from hasp assembly 102.

One embodiment of hasp assembly 102 has an assembly body 103 that includes a back plate 106 and a front plate 108 attached to the back plate. A locking bar 110 is slidable between back plate 106 and front plate 108. A hasp 112 is attached to the assembly body and includes a first hasp jaw 114 and a second hasp jaw 116 operable between an open position and a closed position in response to movement of the locking bar 110 from an unlocked position to a locked position, respectively.

As discussed in more detail below, locking bar 110 in one embodiment slides along body 103 in engagement with second hasp jaw 116, thereby causing second hasp jaw 116 to pivot or move relative to first hasp jaw 114 to open or close hasp 112. Lockout system 100 of FIG. 4 is shown with hasp 112 and locking bar 110 in the closed position with tags 104 received in body 103 and with tag openings 105 aligned with lock openings 124 in body 103. In this condition, a padlock 109 or the like may be installed through tag(s) 104 and body 103 to prevent removal of tag(s) 104. Accordingly, lockout system 100 is secured in the closed position until all tags 104 have been removed from hasp assembly 102. As illustrated, hasp assembly 102 is constructed to receive up to eight tags 104; however, each hasp assembly 102 may have more or fewer slots 118.

In some embodiments, body 103 optionally includes an adjustable tumbler assembly 120 useful to communicate a lockout date or other information to the user. Tumbler assembly 120 is discussed in more detail below with reference to FIGS. 10 and 11.

Body 103 defines a plurality of channels or tag slots 118, each of which is sized and shaped to slidingly receive one tag 104. As shown in FIG. 4, tag slots 118 are channels machined or formed into back plate 106, where tag slots 118 extend horizontally along body 103 when hasp 112 is positioned at the top of lockout system 100. Front plate 108 is attached to back plate 106 to partially close tag slots 118 and prevent removal of tags 104 except by sliding along back plate 106 in a direction away from locking bar 110.

In some embodiments, tag slots 118 may be formed with an overhang, rail, or other feature that engages each tag 104 and requires installation and removal of tags 104 only by sliding tags 104 along tag slots 118 towards or away from locking bar 110. In such an embodiment, front plate 108 may be optional since it is not needed to retain tags 104 in tag slots 118. Similarly, back plate 106 may be formed with features that engage locking bar 110 to permit it to slide along back plate 106 towards or away from hasp 112, yet without being removed from back plate 106.

When tags 104 are installed fully into tag slot 118 and into recess 122 of locking bar 110, each tag opening 105 aligns with lock opening 124 in back plate 106. Each lock opening 124 may also extend through front plate 108 depending on the location of lock opening 124 and geometry of front plate 108, if present. Each slot 106 intersects a path of locking bar 110, which slides along back plate 106 to operate hasp 112 between an open position and a closed position.

In the closed position shown in FIG. 4, upper end 110*a* of locking bar 110 abuts or is closely adjacent a base portion 116*a* of second hasp jaw 116, thereby providing a physical barrier that prevents its rotation about fastener 116*b*. When one or more tags 104 are installed in tag slots 118 and extend into recesses 122 of locking bar 110, tag(s) 104 intersect the sliding path of locking bar 110 towards or away from hasp 112 to lock the position of locking bar 110. However, to permit tags 104 to engage recesses 122, locking bar 110 must be in the closed position so that tag slots 118 and recesses 122 align and allow tag(s) 104 to extend into recesses 122. Thus, when one or more tags 104 are inserted into tag slots 118 with locking bar 110 in the closed position, locking bar 110 and second hasp jaw 116 are prevented from moving out of the closed position. A padlock 109 is installed through tag opening 105 and lock opening 124 of one of the tags 104 to secure the tag 104 in hasp assembly 102.

Figure 5:
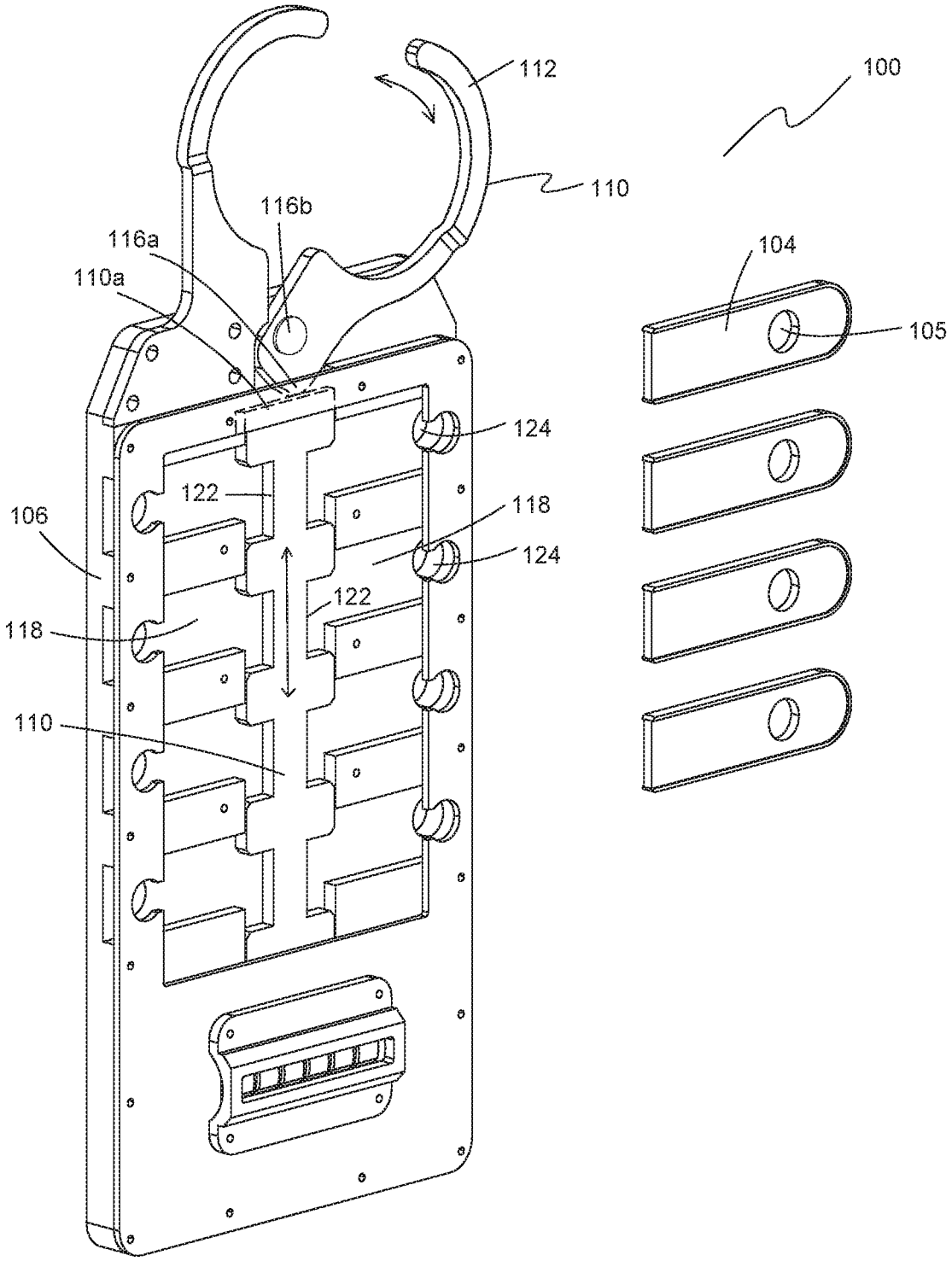
FIG. 5 illustrates the lockout system of FIG. 4 showing the lockout system in an open position with tags removed from the hasp assembly.
Figure 6:
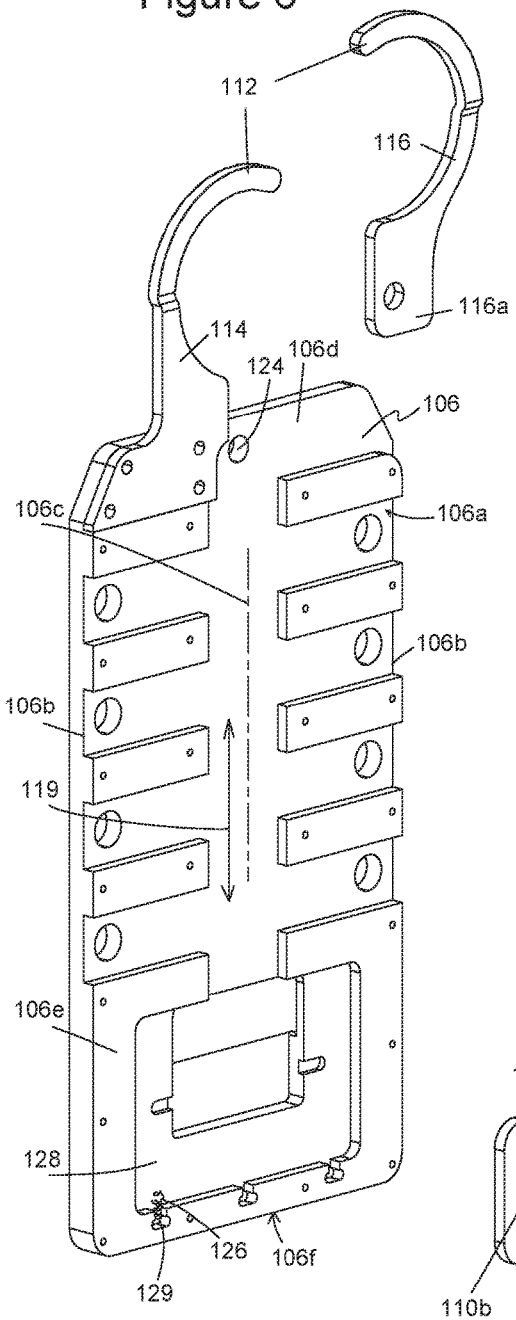
FIG. 6 illustrates one embodiment of a back plate and hasp of the present invention.

Referring now to FIG. 5, lockout system 100 is shown with tags 104 removed from body 103, locking bar 110 moved away from hasp 112 to the unlocked position, and second hasp jaw 116 pivoted about fastener 116*b* to the open position. In doing so, base portion 116*a* of second hasp jaw 116 engages upper end 110*a* of locking bar 110 and forces it to slide away (e.g., downward) from hasp 112. In the open position, recesses 122 of locking bar 110 are not aligned with tag slots 118. Therefore, tags 104 cannot be inserted into slots 118 to align tag openings 105 with lock openings 124. The user must move the locking bar 110 to the locked position (shown in FIG. 4) with recesses 122 aligned with slots 118 in order to install tags 104 and attach a padlock 109 (shown in FIG. 4).

In one embodiment, locking bar 110 is spring-biased towards the locked position. Therefore, when second hasp jaw 116 is moved to the closed position, the spring force moves locking bar 110 to the closed position with recesses 122 aligned with tag slots 118 in back plate 106. In other embodiments, locking bar 110 is spring-biased towards the unlocked position.

Referring now to FIGS. 6-9, components of lockout system 100 are shown in a perspective, exploded diagram. One embodiment of back plate 106 is shown in of FIG. 6 with a vertical orientation as is typical during use. As noted above, back plate 106 defines a plurality of tag slots 118 extending in a horizontal direction across front face 106*a* of back plate 106. In one embodiment, tag slots 118 extend from a back plate edge 106*b* towards a back plate centerline 106*c*. Tag slots 118 may extend from one or both back plate edges 106*b* towards back plate centerline 106*c*. Tag slots 118 opposite each other of back plate centerline 106*c* may align with each other or may be vertically offset. In any case, all tag slots 118 are positioned to align with recesses 122 of locking bar 110 when locking bar 110 is in the locked position.

To receive locking bar 110, back plate 106 also defines a locking bar slot 119 extending transversely (e.g., perpendicularly) to tag slots 118. In one embodiment, locking bar slot 119 extends along back plate centerline 106*c* and is perpendicular to tag slots 118. In one embodiment, locking bar slot 119 and tag slots 118 are co-planar on back plate, but this is not required. For example, locking bar slot 119 and tag slots 118 may be formed to different depths in front face 106*a* to accommodate tags 104 and locking bar 110 between back plate 106 and front plate 108 of when tags 104 and locking bar 110 have different thicknesses.

First hasp jaw 114 is secured to or formed with upper end portion 106*d* of back plate 106 with first hasp jaw 14 extending away from upper end portion 106*d* to define a portion of a closed loop. A mounting hole 124 through upper end portion 106*d* of back plate 106 is used to rotatably secure second hasp jaw 116, such as by a screw, rivet, or other fastener 116*b* configured to allow second hasp jaw 116 to rotate about mounting hole 124. Second hasp jaw 116 is mounted to back plate 106 to overlap or otherwise align with first hasp jaw 114 to complete and define a closed loop when second hasp jaw 116 is in the closed position.

Lower end portion 106*e* of back plate 106 defines a lower recessed area 128 that receives lower end 110*c* of locking bar 110. In one embodiment, lower recessed area includes one or more springs 126 or other biasing device 126 positioned between lower end portion 110*c* of locking bar 110 and bottom end 106*f* of back plate 106 to bias locking bar 110 towards the locked position. For example, lower recessed area 128 defines one or more spring recesses 129 that partially receive springs 126.

Figure 7:
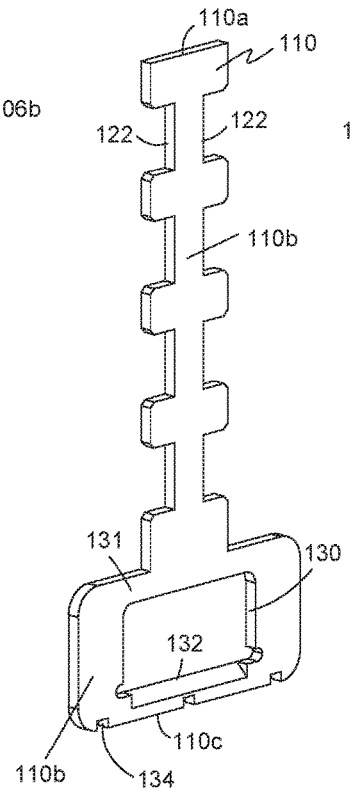
FIG. 7 illustrates one embodiment of a locking bar of the lockout system of the present invention.

FIG. 7 illustrates one embodiment of locking bar 110. In this embodiment, locking bar 110 has upper end 110*a* to engage base portion 116*a* of second hasp jaw 116 and extends along locking bar body 110*b* to a lower end 110*c*. Notches or recesses 122 extend transversely (e.g., perpendicularly) into locking bar body 110*b*. Each recess 122 is shaped and sized to receive an end portion of tag 104. Recesses 122 correspond to and align with respective channels 118 in back plate 106 when locking bar 110 is in the closed position. In some embodiments, upper end 110*a* of locking bar 110 and second jaw 116 are one piece, where first hasp jaw 114, receives part of second hasp jaw 116 or otherwise interfaces with second hasp jaw 116 when hasp 112 is in the closed position. For example, second hasp jaw 116 is formed with or fixedly attached to locking bar 110, where sliding movement from the unlocked position to the locked position closes hasp 112.

In some embodiments, lower end portion 110*b* of locking bar 110 defines a frame 131 around tumbler opening 130 and includes a tumbler locking edge 132. In one embodiment, tumbler locking edge 132 of frame 131 faces towards upper end 110*a* and is sized to fit into and engage slots 170 in tumblers 154 (discussed below) when locking bar 110 is moved to the locked position. Thus, when locking bar 110 is in the unlocked position, the user may manipulate tumblers 154 to a desired position. When locking bar 110 is moved to the locked position, tumbler locking edge 132 engages tumbler slots 170 to lock the tumblers 154 in the position set by the user. Optionally, lower end 110*c* of locking bar 110 defines one or more locking bar spring recesses 134 to receive spring(s) 126, which may also be received partially by spring recesses 129 in back plate 106.

In other embodiments, frame 131 is a separate component from locking bar 110, where locking bar 110 engages frame 131 and pushes it towards bottom end 106*f* when locking bar 110 is moved to the unlocked position. When tumbler locking edge 132 does not engage slots 170, tumblers 154 are permitted to rotate and therefore can be set as desired by a user.

Figure 8:
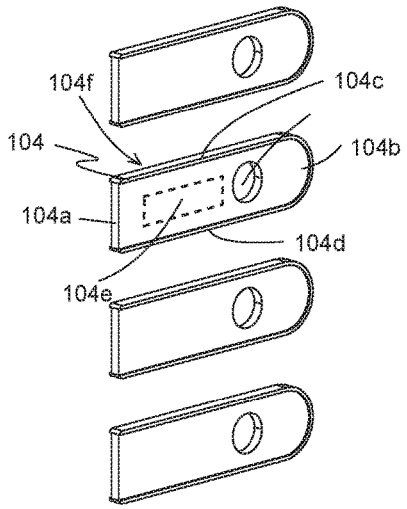
FIG. 8 illustrates a group of tags of the present invention.

FIG. 8 illustrates one embodiment of a set of four tags 104. Each tag 104 extends longitudinally from a first tag end 104*a* to a second tag end 104*b* and defines a tag opening 105. In one embodiment, tag 104 generally is a flat bar with a rectangular cross-sectional shape. Other geometries are acceptable, such as cylindrical, domed, or other shapes. In one embodiment, first tag end 104*a* is rectangular to mate with a rectangular notch or recess 122 in locking bar. In one embodiment, second tag end 104*b* is rounded for comfort and ease of use. Other shapes for first tag end 104*a* and second tag end 104*b* are acceptable. Each tag identifier 104*e* is useful, for example, to identify the name, department, and phone number of the worker locking out the equipment.

In some embodiments, tag 104 defines a ledge, groove, shelf or other feature (not shown) along one or both of sides 104*c*, 104*d* to engage a corresponding mating feature of slot 118. For example, when slot 118 includes overhangs, tag 104 has a shelf or protrusion along sides 104*c*, 104*d* that fits below and slides within the space between the overhang and back plate 106 to maintain tag 104 in slot 118. Similarly, tag 104 and slot 118 may engage each other using a tongue and groove or other mating structure on the respective parts.

Figure 9:
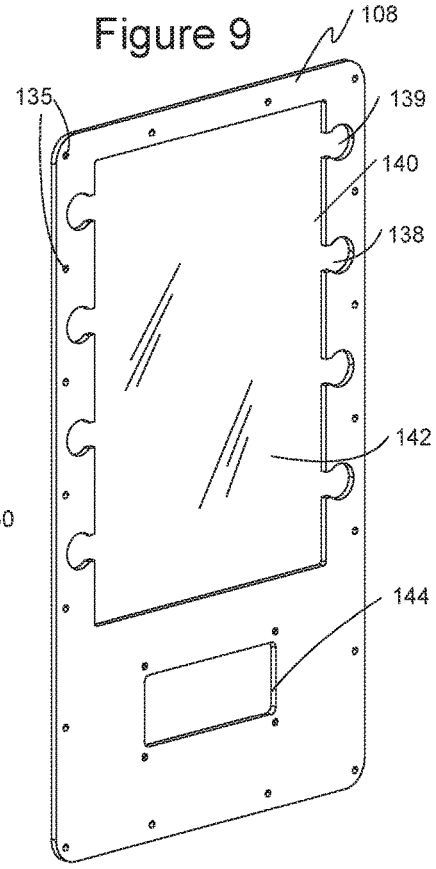
FIG. 9 illustrates a front plate of the lockout system of the present invention.

FIG. 9 illustrates one embodiment of front plate 108. Front plate 108 is sized and shaped to generally overlap and align with all or most of back plate 106, however, this is not required. When slot 118 and tag 104 lack mating structures, front plate 108 is constructed to cover and close all or part of slots 118 and locking bar slot 119 to maintain tags 104 and locking bar 110 together with back plate 106. For example, when front plate 108 is a solid metal plate except for fastener openings 135, it extends fully across back plate 106 and aligns with edges 106*b*. When front plate 108 covers lock openings 124 in back plate 106, front plate 108 defines front plate lock openings 139 that correspond to lock openings 124.

In one embodiment, front plate 108 defines and frames an open region 140 that allows the user to see the position of locking bar 110 and names or other identification on tags 104. Optionally, open region 140 includes a transparent pane 142 of plastic, glass, or other material that restricts access to locking bar 110 and tags 104 yet allows their position or identification to be visible to the user. In embodiments where system 100 includes tumblers 154, front plate 108 defines a tumbler opening 144 sized and located to enable the user to manipulate and view the tumblers 154. Front plate 108 may be secured to back plate 106 using fasteners, welding, clips, or other means.

Figure 10:
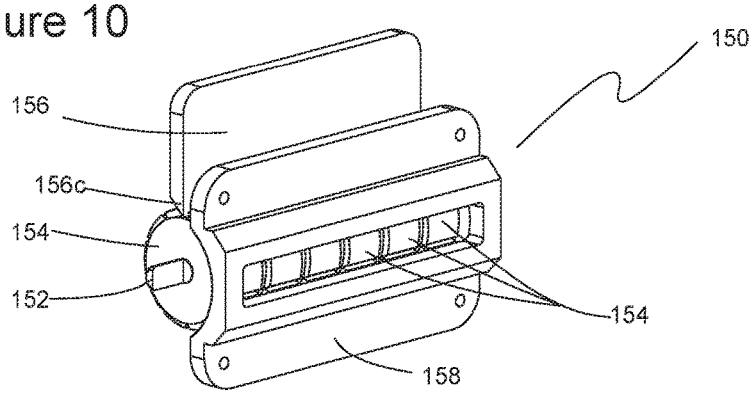
FIG. 10 illustrates an optional tumbler assembly of the present invention.

Turning now to FIG. 10, a perspective view illustrates one embodiment of optional tumbler assembly 150 in assembled form. Tumbler assembly 150 includes axle 152, a plurality of tumblers 154 mounted on and rotatable about axle 152, a resistance pad 156 for engaging tumblers 154, and a cover 158. These components are discussed below in more detail with reference to FIG. 11.

Figure 11:
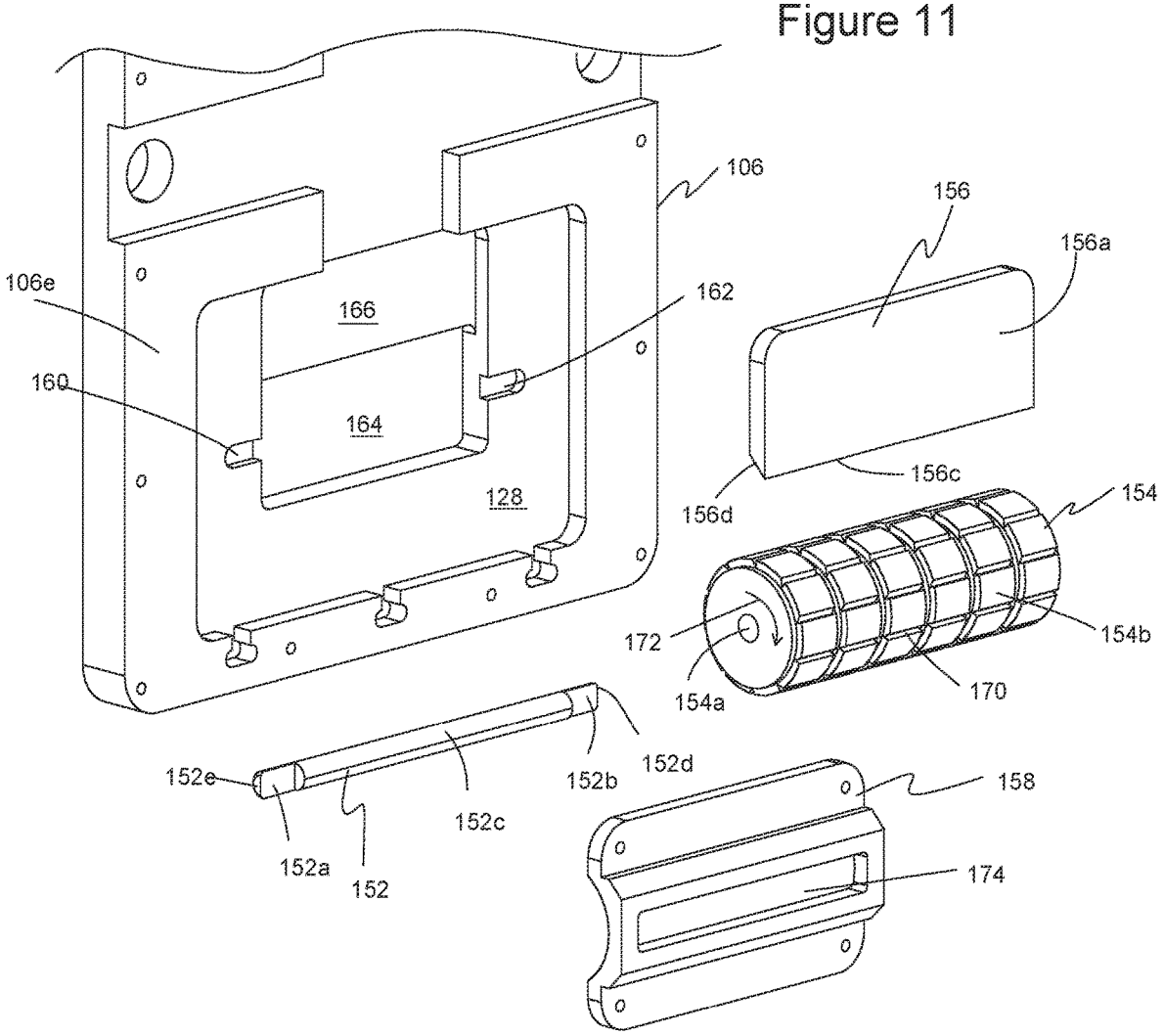
FIG. 11 illustrates the tumbler assembly of FIG. 10 shown in an exploded view with a portion of the back plate.

FIG. 11 is an exploded, perspective view showing components of tumbler assembly 150 and lower end portion 106*e* of back plate 106. In embodiments including tumbler assembly 150, lower recessed area 128 of back plate 106 defines a first axle recess 160 and a second axle recess 162 on opposite lateral edges of a back-plate tumbler opening 164. In one embodiment, tumbler opening 164 is positioned roughly at the center of lower recessed area 128 and permits tumblers 154 to extend through back plate 106 for manipulation by the user. Other positions are acceptable depending on the geometry of frame 131, locking bar 110, and other components.

Axle 152 has a cylindrical axle body 152*c* with optional flats 151*a*, 152*b*, machined into each axle end portion 152*d*, 152*e*, respectively. Axle end portions 152*d*, 152*e* are received in first and second axle recesses 160, 162, respectively, with flats 152*a*, 152*b* flush with or slightly below the surface of lower recessed area 128. Flats 152*a*, 152*b* prevent axle 152 from rotating with tumblers 154. Alternately, axle recesses 160, 162 can be machined to a depth that eliminates the need for flats 152*a*, 152*b*.

Vertically above and immediately adjacent back plate tumbler opening 164 is a resistance pad recess 166. Resistance pad recess 166 is sized and shaped to receive resistance pad 156 with front face 156*a* substantially flush with lower recessed area 128 and with a narrowed edge 156*c* of resistance pad 156 extending beyond resistance pad recess 166 to extend into and engage slots 170 of tumblers 154 as shown in FIG. 10. In one embodiment, resistance pad 156 is a substantially rectangular sheet of rubber or other resilient material. Resistance pad 156 has tapered/narrowed edge 156*c* extending toward tumblers 154 and defining a sloped surface 156*c*. Sloped surface 156*c* is angled at about 45° to front face 156*a* and faces downward and rearward. Thus, when narrowed edge 156*c* engages slots 170 of tumblers 154, tumblers 154 more freely rotate in a direction 172 cooperating with sloped surface 156*d* as compared to impeded rotation when rotating opposite of direction 172.

In another embodiment, resistance pad 156 is replaced with a spring-biased bar with rounded ball pins. The ball pins are biased to engage the tumblers and encourage the tumblers to occupy positions where slots 170 align with the ball pins.

Tumblers 154 are generally cylindrical and have a central opening 154*a* sized to receive axle 152 therethrough. Each tumbler 154 has a plurality of tumbler faces 154*b* evenly spaced circumferentially around tumbler 154 and separated by slots 170. In one embodiment, slots 170 are angled consistently with sloped surface 156*d* to accentuate ease of rotation in direction 172 and resistance to rotation opposite of direction 172.

Tumbler cover 158 attaches to front plate 108 when assembled as shown, for example, in FIG. 5. Tumbler cover 158 defines a view opening 174 that aligns with a row of tumbler faces 154*b*. Thus, when the user manipulates tumblers 154 to identify a date, a name, or other information on tumbler faces 154*b*, that information is visible through view opening 174.

Figure 12:
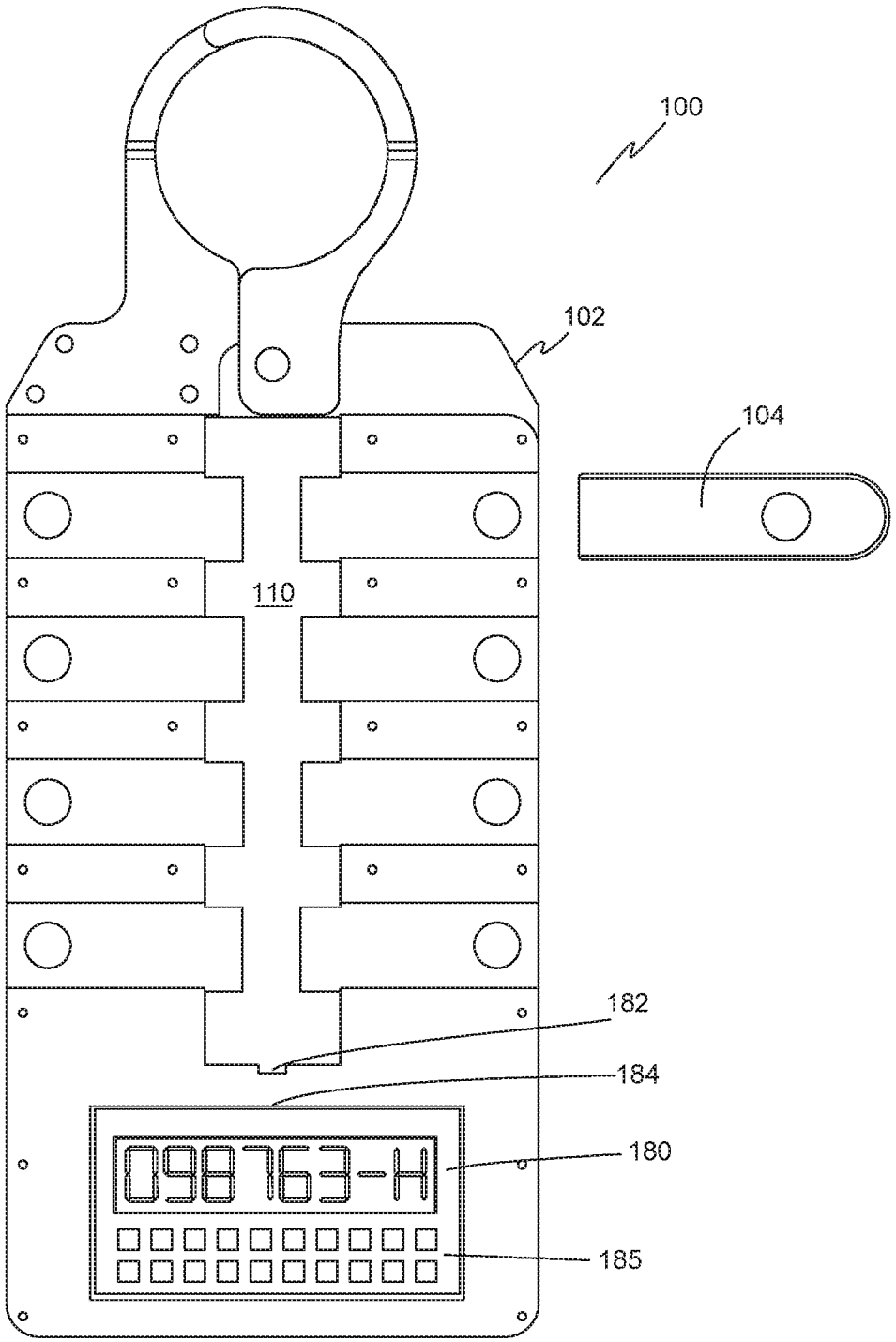
FIG. 12 illustrates a front elevational view of another embodiment of a hasp assembly of the present invention showing an electronic display.

Referring now to FIG. 12, another embodiment of lockout system 100 includes an electronic display 180 instead of tumbler assembly 150. Preferably, the electronic display 180 includes a processor 190 with data storage capability. In one embodiment, electronic display 180 shows the date when hasp assembly 102 was placed into the locked position or other information relevant to the locked-out energy source. Electronic display 180 in some embodiments receives an identifier associated with each tag 104 installed into hasp assembly 102. Electronic display also records the date when each tag 104 was installed and/or removed. In some embodiments, electronic display 180 allows the user(s) to input a date, identifier, name, work code, or other information. In some embodiments, a user may use a user-input device 185, such as a keypad or touch screen to access and view data stored in electronic display 180 and to determine who locked out the equipment and date of doing so.

In one embodiment, for example, the electronic display 180 is converted from an unlocked display condition to a locked display condition when the locking bar 110 is moved from the unlocked position to the locked position, respectively. In doing so, the locking bar 110 engages or disengages a switch, electrical contact, button, or the like on the electronic display 180 to cause the electronic display 180 to change condition. When the locking bar 110 is in the unlocked position, for example, a protrusion 182 on locking bar 110 disengages from a contact 184 or the like on electronic display 180, thereby changing electronic display 180 to the unlocked display condition. When unlocked, a user may input a date or other information relevant to the use of the lockout system 100. When locking bar 110 is moved to the locked position, protrusion 182 engages contact 184 and electronic display 180 is changed to the locked display condition and a user may not input new data or change entered data.

When one or more tags 104 are installed in hasp assembly 102, the processor 190 of electronic display 180 receives and records the identifier associated with each tag 104 and the date each tag 104 was installed. Other information may optionally be stored, such as the slot number on the hasp assembly 102, a code identifying work to be performed, a tag removal date, an identifier for the work to be performed, and other similar information. Optionally, when locking bar 110 is moved to the unlocked position, the data received from each tag 104 installed in the hasp assembly 102 are stored in a history file that includes information such as the identifier associated with each tag 104 installed in the hasp assembly 102, the date each tag 104 is installed in hasp assembly 102, and the date removed from hasp assembly 102. In some embodiments, electronic display 180 is programmable to collect and store information as desired or suitable. As such, electronic display 180 may include a keypad 185 or other data entry mechanism.

Figure 13:
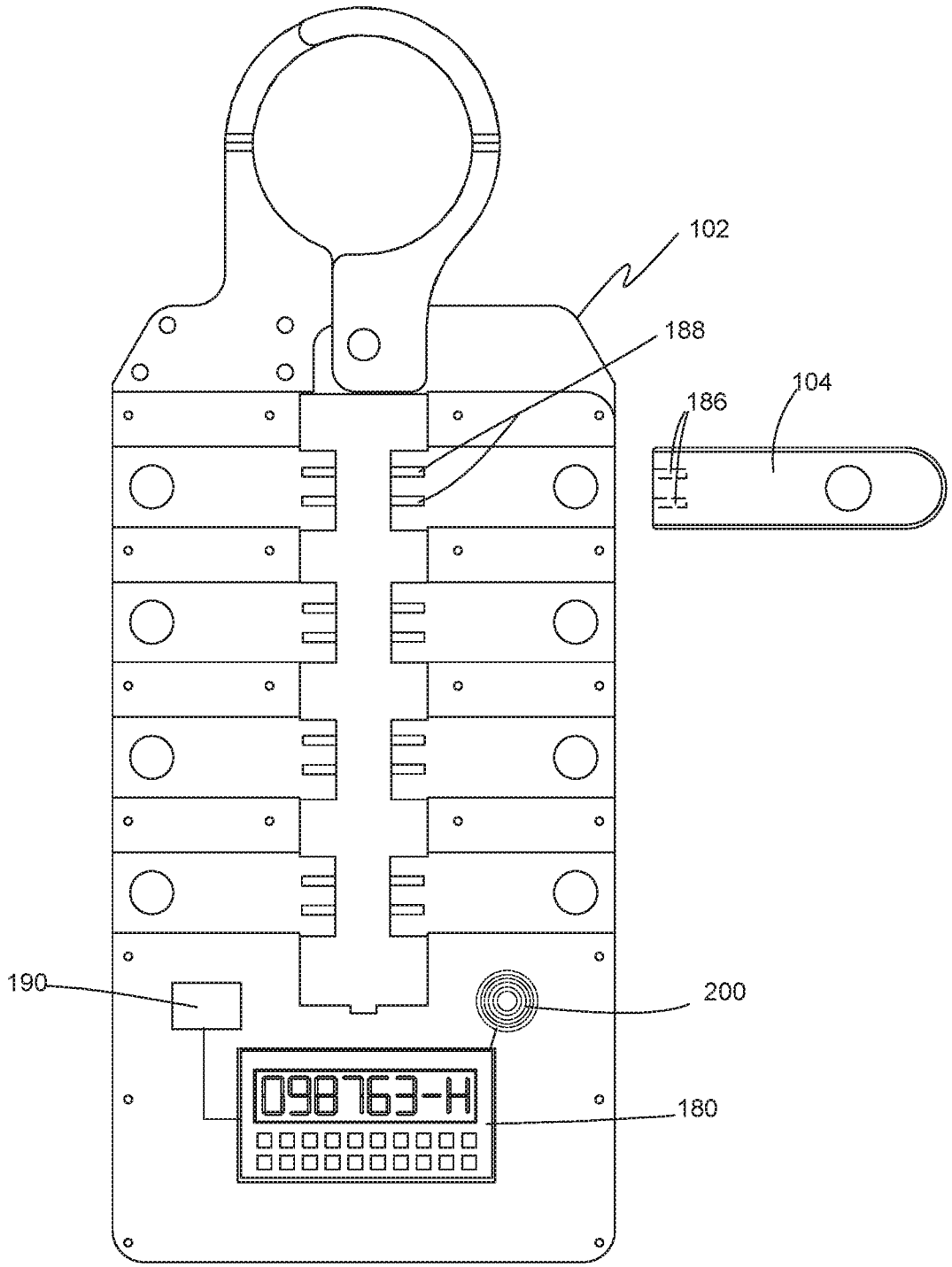
FIG. 13 illustrates a front elevational view of another embodiment of a hasp assembly of the present invention showing an electronic display and electrical contacts to complete a circuit between the display's processor and tags installed in the hasp assembly.

Referring now to FIG. 13, another embodiment of lockout system 100 is illustrated with hasp assembly 102 and a plurality of tags 104. In this embodiment, each tag 104 is configured and constructed to communicate with processor 190 in hasp assembly 102. As shown, processor 190 is part of electronic display 180; however, processor 190 is not necessarily part of electronic display 180. When hasp assembly 102 includes electronic display 180, processor 190 may be part of or coupled to electronic display 180.

In one embodiment, for example, contacts 186 on the tag 104 engage contacts 188 in a tag slot 118 on the hasp assembly 102 when tag 104 is installed in hasp assembly 102. Each tag 104 may be coded with a worker identifier, contact information, and other relevant information. When each tag 104 is installed in a tag slot 118, a circuit is completed and the processor 190 receives the data associated with each tag 104. For example, processor 190 receives and displays the worker's identity and a date the tag 104 was installed in the hasp assembly 102. Optionally, the processor 190 includes a transceiver 200 for communicating wirelessly with a computer 240 and database 245 (shown in FIG. 14). With such a system, for example, each hasp assembly 102 communicates to the computer 240 the data received by processor 190 from each tag 104 as well as information determined by or stored in processor 190, such as a date or hasp identifier.

Figure 14:
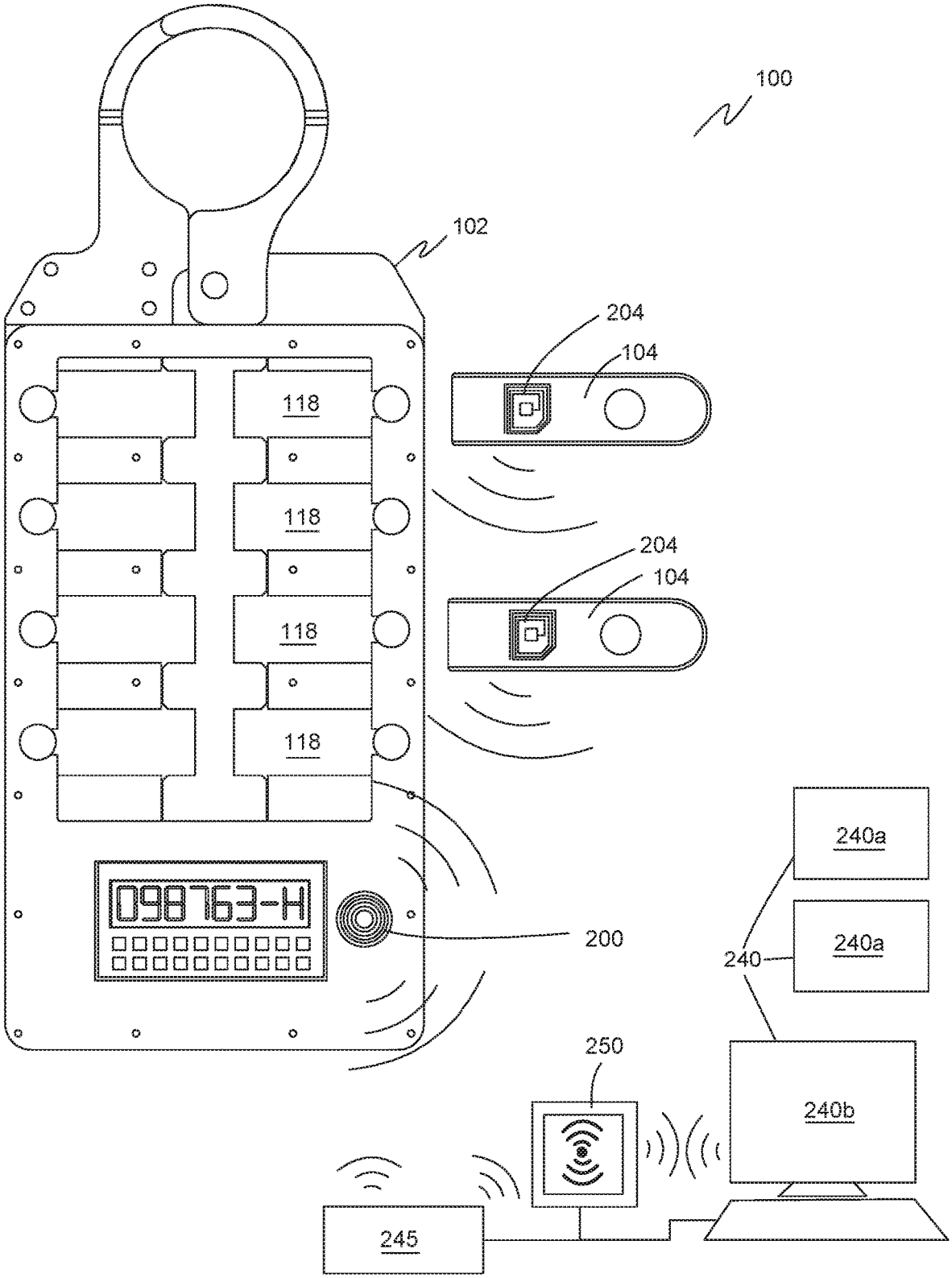
FIG. 14 illustrates an embodiment of a lockout system of the present invention showing a hasp assembly with transceiver circuit, tags with a transmitter circuit, computers, a database, and a wireless network router.

Referring now to FIG. 14, yet another embodiment of lockout system 100 is illustrated with hasp assembly 102, a plurality of tags 104, a wireless network router 250, and a plurality of computers 240. Hasp assembly 102 communicates with tags 104 wirelessly or by a circuit formed when tags 104 are installed in the hasp assembly 102. Hasp assembly 102 communicates with data base 245 and computers 240 using wireless router 250.

In one embodiment, each tag 104 is equipped with a transmitter 204 and hasp assembly 102 is equipped with a transceiver 200, where the transmitter 204 is configured to respond to a radio frequency signal transmitted by transceiver 200, such as a data request. In some embodiments, transmitters 204 are passive: each transmitter 204 powers up and sends a reply signal after receiving a query from the transceiver 200. The reply signal from tag 104 contains a tag identifier or other data that is received by the transceiver 200. In other embodiments, transmitters 204 are active and periodically transmit a signal containing the tag identifier. Regardless of whether tag 104 communicates with hasp assembly 102 using wireless or wired means, when a tag 104 is installed in the hasp assembly 102, transmitter 204 of the tag 104 communicates with transceiver 200 in the hasp assembly 102. In doing so, the hasp assembly 102 recognizes the presence of one or more tags 104 installed in tag slots 118 of the hasp assembly 102. Hasp assembly 102 may record and display the information on the hasp assembly 102 only, or may communicate the information to database 245.

In some embodiments, transceiver 200 is configured to communicate wirelessly with database 245 and/or one or more computers 240, such as via a wireless network of the Internet. Each computer 240 may be a general-purpose desktop computer, a tablet computer, a smart phone, a data logger, or other electronic device configured to display status indicators of lockout system 100. In one embodiment, transceiver 200 communicates with computers 240 using a local area network with a wireless internet router 250.

In some embodiments, transmitter 204 and transceiver 200 are configured to communicate using an electromagnetic field with a frequency of 120 KHz to 140 KHz. Frequencies of 125 KHz, for example, have been found to be better suited due to reduced interference from metal objects. In other embodiments, the electromagnetic field has a frequency of 13.56 MHz, 900 MHz, 2.4 GHz, 5 GHz, or other frequency suitable for the range, antenna size, and environment where lockout system 100 will be used. In some embodiments, communication between tag 104 and transceiver 200 uses a first frequency of 120 KHz to 140 KHz while communication between transceiver 200 and computer 240 uses a second frequency that is different from the first frequency, such as 2.4 GHz.

In one embodiment, each computer 240 and each hasp assembly 102 wirelessly communicate with database 245. The database 245 may be maintained in one or more computer 240 or at some other location accessible by each computer 240 in system 100, such as "the cloud" or a remote location. In one embodiment, database 245 acts as the master data storage location for all hasp assemblies 102 in lockout system 100. Database 245 is preferably updated in real time when a change occurs at any of the hasp assemblies 102 and stores information for each hasp assembly 102. Periodic updates are also acceptable, either by a data push from hasp assemblies 102 or a data pull from database 245. A condition change at any hasp assembly 102 includes a change in tags 104 installed in hasp assembly 102, a change between locked and unlocked status of the hasp assembly 102, change of a date for end-of-work, and the like. Using the database 245 that is distinct from hasp assemblies 102 reduces the computing requirements and power requirements for each hasp assembly 102.

By viewing the data on a computer 240, such as tablet computers 240*a* carried by management and supervisors or desktop computers 240*b* in an office, the management is informed of the current lockout status of each energy source without having to visit each worksites throughout the facility. As noted above, for example, each computer 240, database 245, and each hasp assembly 102 communicate using a wireless internet router 250. Data communicated from the hasp assembly 102 may include a unique tag ID, an energy source identifier, a worker identifier, a lockout date, a tag installation date, a tag removal date, and/or a lockout status identifier. For example, for each energy source identified as locked-out, computer(s) 240 display the identity of the worker(s) who have locked out the energy source, the dates each tag 104 was installed in the hasp assembly 102, and other information as deemed appropriate. Further, by communication between each hasp assembly 102, database 245, and computer(s) 240, management and workers may be able to determine the location of each hasp assembly 102, whether in use or not, thereby preventing loss of hasp assemblies.

Lockout system 100 with embodiments of hasp assemblies 102 and tags 104 discussed herein is used to lockout one or more piece of equipment or energy source. After placing hasp 112 in the open position, hasp 112 is attached through an opening on a switch, valve, control panel, or other control tied to the energy source. After closing the hasp 112 and moving the locking bar 110 to the locked position, each user performing work on the energy source may independently install his/her tag 104 into an open slot 118 of hasp assembly 102. The user then locks the tag 104 into the hasp assembly 102 with a padlock 109 or other secure device placed through tag opening 105 and lock opening 124.

Depending on the embodiments of hasp assemblies 102 and tags 104, lockout system 100 may be used to facilitate compliance with lockout/tagout protocol and manage locked energy sources at a facility.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

I claim:

1. A lockout system comprising:

a plurality of tags each comprising an elongated plate with a first end and a second end, wherein each of the plurality of tags defines a tag opening; and a hasp assembly comprising: a hasp body, a first hasp portion defining a first loop portion, and a second hasp portion defining a second loop portion, the hasp body defining a plurality of slots, wherein each of the plurality of slots is sized and shaped to receive one of the plurality of tags, the hasp body further defining a plurality of lock openings, and wherein each of the plurality of lock openings is sized, shaped, and positioned to align with the tag opening of a respective one of the plurality of tags received within a respective one of the plurality of slots;

wherein the second hasp portion and the first hasp portion are movable relative to one another, such that the first hasp portion and the second hasp portion have at least: (a) a first position, in which the hasp assembly is in an unlocked position, and (b) a second position, in which the hasp assembly is in a locked position;

wherein when at least one tag of the plurality of tags is received in the hasp body, the hasp assembly is prevented from moving to the unlocked position, thereby preventing the hasp assembly from changing to the unlocked hasp position.

2. The lockout system of claim 1, wherein the hasp body comprises:

a back plate defining the plurality of slots; and a front plate aligned with and secured to the back plate, thereby defining entrance openings between the back plate and the front plate for each of the plurality of slots.

3. The lockout system of claim 1, further comprising a tumbler assembly in the hasp body.

4. The lockout system of claim 1, further comprising an electronic display on the hasp body, the electronic display configured to recognize the presence of one or more of the plurality of tags installed in the hasp assembly.

5. The lockout system of claim 4 further comprising;

electrical slot contacts in each of the plurality of slots and coupled to the electronic display; and electrical tag contacts on each of the plurality of tags;

wherein any one or more of the plurality of tags installed in the hasp body results in a completed circuit with the electronic display.

6. The lockout system of claim 4 further comprising:

a transmitter circuit on each of the plurality of tags; and a transceiver circuit coupled to the electronic display;

wherein each of the plurality of tags communicates wirelessly with the electronic display when installed in the hasp assembly.

7. The lockout system of claim 4 further comprising:

a database disposed in communication with the hasp assembly;

one or more computers disposed in communication with the database;

wherein the hasp assembly communicates lockout information to the database and each of the one or more computers is configured to display the lockout information to a user.

8. The lockout system of claim 7, wherein the lockout information includes one or more data selected from the group consisting of a lockout status, a tag identifier, a lockout date, and a slot identifier.

* * * * *